US008672186B2

(12) United States Patent
Geiberger

(10) Patent No.: US 8,672,186 B2
(45) Date of Patent: Mar. 18, 2014

(54) MULTI-CHAMBER CONTAINER

(75) Inventor: Christoph Geiberger, Königswinter (DE)

(73) Assignee: Scapa Holding GmbH, Eschborn (DE)

( * ) Notice: Subject to any disclaimer, the term of this patent is extended or adjusted under 35 U.S.C. 154(b) by 818 days.

(21) Appl. No.: 12/593,484

(22) PCT Filed: Mar. 28, 2008

(86) PCT No.: PCT/EP2008/002491

§ 371 (c)(1),
(2), (4) Date: Sep. 7, 2010

(87) PCT Pub. No.: WO2008/116664

PCT Pub. Date: Oct. 2, 2008

(65) Prior Publication Data

US 2011/0068123 A1 Mar. 24, 2011

(30) Foreign Application Priority Data

Mar. 28, 2007 (DE) ..... 20 2007 004 662 U

(51) Int. Cl.
*B67D 7/70* (2010.01)

(52) U.S. Cl.
USPC ..... 222/135; 222/129; 222/145.1; 222/386

(58) Field of Classification Search
USPC ..... 222/94, 95, 105, 402.1, 129, 135–137, 222/251–253, 256, 321.7, 321.9, 153.1, 222/153.04, 153.12, 153.14, 213–215, 222/145.3, 520, 548, 160, 249, 254, 280, 222/283, 320, 321.4, 340, 402.21, 361, 351
See application file for complete search history.

(56) References Cited

U.S. PATENT DOCUMENTS 3,318,494 A * 5/1967 Porter et al. ..... 222/534
3,437,242 A * 4/1969 Poitras ..... 222/135

(Continued)

FOREIGN PATENT DOCUMENTS

EP 1537916 A 6/2005
EP 1547937 A 6/2005

(Continued)

OTHER PUBLICATIONS

International Search Report from PCT/EP2008/002491, dated Jun. 4, 2008. (9 pages).

*Primary Examiner* — Frederick C Nicolas
(74) *Attorney, Agent, or Firm* — Edell, Shapiro & Finnan LLC

(57) ABSTRACT

The present invention relates to a multi-chamber container having a container housing (4), which comprises a first chamber (1) for receiving a first product component and a second chamber (2) for receiving a second product component. The container further has a device (15, 16; 60, 61) for producing a pressure difference delivering the first and/or second product components out of the respective chamber, a removal opening (33), which communicates with the first chamber (1) and/or the second chamber (2) and is disposed on a housing head (3, 53), and further a metering device (3, 15, 16; 60, 61, 66) for dispensing the product component from the first and/or second chambers (1, 2). The object of the present invention is to provide a multi-chamber container, which has a relatively space-saving and compact design. In order to achieve this objective, the invention proposes that the first chamber (1) be disposed between the second chamber (2) and the housing head (3) and that the removal opening (33) communicates with a rising pipe (12), which penetrates the first chamber (1) and extends into the second chamber (2).

16 Claims, 5 Drawing Sheets

(56) References Cited

U.S. PATENT DOCUMENTS

| | | | | |
|---|---|---|---|---|
| 4,014,463 | A * | 3/1977 | Hermann | 222/135 |
| 4,029,236 | A * | 6/1977 | Carson et al. | 222/135 |
| 4,488,663 | A * | 12/1984 | Hooper et al. | 222/43 |
| 4,511,068 | A * | 4/1985 | Bossina | 222/257 |
| 4,811,871 | A * | 3/1989 | Wass et al. | 222/477 |
| 5,174,475 | A * | 12/1992 | Day et al. | 222/144.5 |
| 5,176,291 | A * | 1/1993 | Fillmore et al. | 222/1 |
| 5,215,225 | A * | 6/1993 | Kopp | 222/129 |
| 5,217,145 | A * | 6/1993 | Haan et al. | 222/129 |
| 5,310,091 | A * | 5/1994 | Dunning et al. | 222/135 |
| 5,316,187 | A * | 5/1994 | Drobish et al. | 222/401 |
| 5,637,087 | A * | 6/1997 | O'Neil et al. | 604/82 |
| 5,954,236 | A * | 9/1999 | Virnelson | 222/135 |
| 6,341,717 | B2 * | 1/2002 | Auer | 222/135 |
| 6,848,480 | B2 * | 2/2005 | Brennan | 141/2 |
| 7,237,693 | B2 * | 7/2007 | Brennan et al. | 222/327 |
| 7,455,195 | B2 * | 11/2008 | Mekata | 222/94 |
| 7,481,333 | B2 * | 1/2009 | Goldberg et al. | 222/135 |
| 7,497,354 | B2 * | 3/2009 | Decottignies et al. | 222/135 |
| 7,497,355 | B2 * | 3/2009 | Horner et al. | 222/137 |
| 7,510,101 | B2 * | 3/2009 | Foster et al. | 222/136 |
| 7,748,567 | B2 * | 7/2010 | Horner et al. | 222/135 |
| 2002/0108968 | A1 | 8/2002 | Dumont | |
| 2006/0113325 | A1 * | 6/2006 | Foster et al. | 222/137 |
| 2007/0246482 | A1 * | 10/2007 | Goldberg et al. | 222/129 |
| 2009/0052971 | A1 * | 2/2009 | Pires et al. | 401/172 |
| 2011/0101021 | A1 * | 5/2011 | Greer et al. | 222/1 |

FOREIGN PATENT DOCUMENTS

| | | | |
|---|---|---|---|
| JP | 1078587 | U | 5/1989 |
| WO | 0100521 | A | 1/2001 |

* cited by examiner

MULTI-CHAMBER CONTAINER

FIELD OF THE INVENTION

The present invention relates to a multi-chamber container which can be used as a metering dispenser for dispensing, for example, pasty substances. The present invention particularly relates to a multi-chamber container with several chambers for the accommodation of various product components, which for example can be mixed during dispensing within the container in a dispensing area and discharged as a mixture or however can be discharged as separate components preferably adjacent to one another at a discharge opening and then manually mixed by the user of the container.

The present invention relates to a multi-chamber container with a container housing, which comprises a first chamber for accommodating a first product component and a second chamber for accommodating a second product component. The multi-chamber container also has a device for producing a pressure difference for ejecting the first and/or the second product component from the relevant chamber and a removal opening, which communicates with the first and/or the second chamber and which is provided on a housing head of the container housing. Finally, the multi-chamber container has a metering device for discharging a predeterminable amount of first and/or second product component.

BACKGROUND OF THE INVENTION

A generic class-forming multi-chamber container, which due to the device for producing a pressure difference is also designated as multi-chamber dispenser, is for example known from EP 1 077 888, EP 1 516 613, EP 1 503 865 and EP 0 755 721.

With prior-art multi-chamber containers a device for producing a pressure difference is provided at the front of each chamber for product removal. The volume flows produced by this are changed by a mechanical regulating device which is integrated into the housing head. In other words a separate device for producing a pressure difference respectively a pump is provided for each chamber. The chambers are located adjacently, i.e. each terminating in the region of the housing head. Accordingly, the prior-art multi-chamber container needs a relatively large base area.

The object of the present invention is to specify a multi-chamber container which can be realised compactly in a relatively space-saving manner. For the purpose of this invention a multi-chamber container is taken to be a container with at least two, optionally three or several separate chambers each for accommodating different product components.

SUMMARY OF THE INVENTION

To solve this problem a multi-chamber container having the features of Claim 1 is suggested by this invention. This differs from the generic class-forming state of the art in that the first chamber is arranged between the second chamber and the housing head. In other words the respective chambers which are separated from one another are not positioned adjacently, but instead one above the other in the longitudinal direction of the container. A chamber is provided in the region of the bottom. The oppositely situated end of the container housing has a removal opening with the housing head. At least one, optionally also two or several chambers are provided between the lower chamber and the housing head. Furthermore, the multi-chamber container according to the invention has a rising pipe which communicates with the removal opening and protrudes into the second chamber. Accordingly, the rising pipe passes through the first chamber. Where more than two chambers are provided on the multi-chamber container, several appropriate rising pipes extend in each case from the housing head into the assigned chamber.

A rising pipe for the purposes of this invention is taken to be any means which is suitable in facilitating a flow between the corresponding chamber and the removal opening. It is not essential that the rising pipe is rigid. It can also be bendable or foldable. This type of embodiment may be suitable for example with a multi-chamber bag with chambers which reduce their volume with increasing removal of product components from the container. The rising pipe can only extend to the upper region of the chamber. In the case of a pump for the removal of products from the corresponding chamber the rising pipe can also extend as a flexible hose up to the bottom of the assigned chamber.

For the purpose of this invention a chamber is also optionally taken to be a variable space, which in itself or through the accommodation of a bag is suitable for accommodating the amount of product to be stored in the multi-chamber container and to be dispensed through it. A chamber is in particular taken to be an accommodation space, which is suitable for storing an adequate amount of the product component, so that product can be removed repeatedly. The stored volume is normally large compared to that during dispensing, i.e. the volume dispensed by the actuation of the device for producing the pressure difference or by the dispensing device.

The multi-chamber container according to the invention may comprise a manually operated pump for dispensing a dosing volume in a known manner. This pump is normally accommodated in the region of the housing head. Examples of pumps of this nature are described in EP 1 077 880 or EP 1 399 370. In these examples an actuating button in the region of the housing head also forms the dispensing device for the metered discharge of product from the chambers via the removal opening.

An alternative device for producing a pressure difference for conveying the product from the chambers is formed by a gas pressure chamber which is integrated into the multi-chamber container and namely preferably in the region of the bottom of the container housing and the gas pressure of which is effective in the relevant chambers. With this embodiment the metering device is normally formed by a removal valve which is provided in the housing head and which can be opened manually, so that product is discharged at the removal opening due to the overpressure within the chambers.

In a further alternative embodiment the multi-chamber dispenser can be formed as a type of soap dispenser with several pumps formed in the housing head, for example, ball-valve pumps, to which a hose extending to the bottom of the relevant container is assigned. The hose protruding into the lower container here forms the rising pipe for the purpose of the invention. The realisation of this invention is in principle not restricted to a special pump system. For the realisation of the method contained in Claim 1 basically the arrangement of the various chambers one above the other is essential. Here, the "housing head" can also with regular use of the dispenser be located in the region of the bottom and the oppositely situated end of the cylindrical container can be provided at the upper end for the use of the multi-chamber dispenser.

According to a preferred further development of the present invention the container housing has a cylindrical section in which several pistons are movably arranged one above the other. For example, between the first and second chamber a first piston is movably provided in the cylindrical section. Thereunder a second piston is provided which closes the second chamber. This second piston can engage with its lower end in a familiar manner using spring-type protrusions on the inner circumferential surface of the cylindrical section to facilitate a trailing movement by the piston during volume reduction in the first and/or second or another chamber, however preventing a movement of the piston in the opposite direction.

To improve the guidance of the trailing movement of the first piston it is preferable to form the rising pipe passing through the first piston and to seal it with respect to the piston. Preferably, in this case the rising pipe is located concentrically within the container housing, which is normally formed as a type of longitudinal cylinder. Also with a polygonal base area the arrangement of the rising pipe in approximately the centre of the container is taken to be a concentric arrangement.

The first chamber is covered by a housing cover, which normally closes the multi-chamber container at the top and for example accommodates a removal pipe and optionally a metering device of the container. Depending in particular on the embodiment of the metering chamber, this chamber cover can be shaped. A shape of this nature can be already produced in that for producing a pressure difference a metering pump is provided in the vicinity of the chamber cover, which protrudes from the chamber cover towards the assigned chamber. Further reasons for a shaped surface of the chamber cover are based on the arrangement of valve elements and/or on the embodiment of specifically required flow paths. It is known how to embody the trailing piston of a container such that it is formed to match the shape of the chamber cover with its surface assigned to the chamber cover. According to a preferred embodiment of this invention it is suggested with regard to emptying the chamber container as completely as possible that the chamber cover covering the housing head, the first piston and the second piston and optionally each further piston is embodied such that shapes formed on these components engage one another when the chambers are emptied to the maximum extent. Here, an embodiment is required in which the pistons move into one another with almost no gap during maximum emptying, so that the multi-chamber container can be almost completely emptied.

As a definitive embodiment of this preferred further development, it is furthermore suggested that a metering chamber, in which a metering piston is movably supported, is provided protruding from the housing head into the first chamber preferably concentrically to the cylindrical section. The first piston has a pot-shaped recess matching the protruding metering chamber. The second piston has a second pot-shaped recess, which fits into the first pot-shaped recess of the first piston.

A cylindrical rising pipe receptacle is formed in the second, i.e. the last piston, for the use of a relatively rigid rising pipe. In this embodiment the second, i.e. last piston, normally has a pot-shaped recess for a protrusion from the movable piston situated above it. The rising pipe receptacle normally extends from this pot-shaped recess. In particular a concentric embodiment is considered. A rotationally symmetrical structure of the multi-chamber container in the vicinity of the cylindrical section should in any case be the normal configuration.

According to another preferred embodiment of the present invention a centring pin, which penetrates into the rising pipe when the chambers are emptied to the maximum extent, is provided in the rising pipe receptacle. Here, an adequate gap, which facilitates further emptying of the chamber, remains between the inner circumferential surface of the rising pipe and the external circumferential surface of the centring pin. The centring pin can be formed hollow inside, in order for example to hold a bottom plate which covers the last piston and in any case closes the cylindrical section on the underside at the height of this piston. The rising pipe receptacle preferably forms at its base a sealing face for the rising pipe, the free end of the rising pipe making contact to the sealing face when the second chamber is emptied to the maximum extent. In this way, any air contained in the second chamber is prevented from being drawn off through the rising pipe, which can lead to splashing or sudden discharge of product at the removal opening.

According to a further preferred embodiment of the present invention, the metering piston is mounted on a metering duct, which extends in the actuation direction of the metering piston and opens out into a discharge chamber for one of the product components. Apart from the discharge chamber for one of the product components, here another discharge chamber is preferably provided for the other product component. With this preferred further development the first discharge chamber and the other discharge chamber are provided at about the same height with discharge openings from which a removal pipe protrudes, which is pivotably supported about the discharge chambers. This preferred further development facilitates a change of the mixing ratio with a compact and simple structure of the multi-chamber container. The discharge openings are located at about the same height in an axial direction with respect to the longitudinal axis of the metering piston. By pivoting the removal pipe it can be brought alternatively to cover the required discharge opening, whereas a wall adjacent to the removal pipe, in particular a wall of a cylindrical flange which surrounds the discharge chambers and pivotably supports the removal pipe, surrounds the other discharge opening and closes it, so that also with an overpressure acting on the assigned chamber no corresponding product component can be discharged.

This embodiment offers the possibility of forming the discharge chamber like pieces of a cake in the vicinity of the housing head and of providing it with discharge openings, which with an appropriate embodiment of the removal pipe can communicate selectively or in groups with the removal pipe in order to remove the required product component(s). The embodiment has in particular advantages for product components which would react together. For example, it is possible with this embodiment to bring the product components into contact with one another only directly after they have been dispensed from the multi-chamber container. Embodiments are also conceivable in which the removal pipe has various flow channels which are separated from one another so that the product separation can be maintained up to the removal opening. Furthermore, through pivoting the removal pipe into a position in which none of the discharge openings communicate with the removal pipe and only adjacent wall sections of the removal pipe close off the relevant discharge openings, it is possible to prevent the product being held ready in the vicinity of the housing head coming into contact with air and oxidising or being otherwise impaired by the atmosphere.

According to a further preferred embodiment of the present invention in which the removal pipe can be arranged appropriately aesthetically and the metering device ergonomically designed, the removal pipe is connected to a metering head which is movable in the actuation direction of the metering piston and is pivotably supported on the container housing. Via this metering head the position of the removal pipe can be changed relative to the discharge opening of the assigned discharge chamber.

In a relatively simple embodiment the multi-chamber container has only one pump chamber which communicates with one of the chambers. During the removal of product from this chamber by actuation of the pump chamber, the piston closing this chamber runs on. This leads to a pressure difference between this chamber and the other chamber situated above or below it, so that the trailing piston closing off this further chamber also runs on. In other words the only metering chamber forms the pump of the multi-chamber container for the dispensing of all or several product components. This pump operates namely only with one chamber directly. However, due to the pressure equalization between adjacent chambers, also dispensing of product components from the other chamber arises which is not directly connected to the pump. The embodiment has the advantage of simple construction of the multi-chamber container. The principle of a pressure equalization between the individual chambers for dispensing product component is otherwise also only restricted to arrangements in which the relevant chambers are closed by trailing pistons, whereby adjacent chambers border the same trailing piston.

With an alternative embodiment of the invention the chamber cover is formed by a housing partition inserted into the cylindrical section where it latches. This housing partition supports a first and a second metering piston which close off the assigned first and second metering chambers. The first metering chamber communicates through the interposition of a first valve with the first chamber for the product component. The second metering chamber communicates through the interposition of a second valve with the second chamber for the second product component. The first and second metering chambers communicate with a metering channel which in turn communicates with the removal opening. Through this embodiment there is the possibility of controlled dispensing of the first or second product component from the respective chamber. The respectively discharged volume is not dependent on a pressure equilibrium occurring between various chambers.

With the previously mentioned preferred embodiment of the multi-chamber container with at least two metering chambers the metering channels each extend preferably in the actuation direction of the metering pistons and are surrounded by a dispensing pipe, on the front side of which the removal pipe is positioned where it is pivotably supported. Here, the removal pipe can have a closing element, for example a closing tongue, which is formed such that the discharge openings of the metering channels can be completely or partially covered by the closing tongue. Here, the closing tongue is preferably formed such that in one position one of the discharge openings communicates with the removal pipe, whereas the other discharge openings are closed. Furthermore, it is desirable to form the closing tongue such that at an appropriate angular position of the removal pipe relative to the metering channels all discharge openings communicate with the removal pipe. In this design case the effective opening on the removal pipe can be changed by varying the angular position of the metering tongue and the mixing ratio thus adjusted.

According to a further preferred embodiment of the present invention, the housing head is firmly joined to the housing and movably supports a metering button, which is subjected to a return spring, which forces the metering pistons into their initial position. The return spring accordingly provides a reset both of the manually operated metering button, which is exposed on the external surface of the multi-chamber container, and also of the metering pistons inside the multi-chamber container. If there is no manual actuation of the metering button, the return spring holds it and the metering pistons in an initial position. With actuation of the metering button the corresponding metering pistons are forced in the actuation direction, by means of which the chamber volume of the metering chambers is enlarged, fluid drawn off and the fluid located in the metering chambers when the button is released and due to the returning force of the spring is discharged.

A relatively simple embodiment in which the metering and pump device can be inserted as a module into the multi-chamber container can be produced in that the dispensing pipe is formed as one part with the housing partition. The respective metering pistons can be arranged concentrically to the dispensing pipe on this constructional unit. This prefabricated unit is preferably latched to the removal pipe and thus joined in a simple manner.

It has been established that with metering pistons located one above the other which are forced into their initial position by a single return spring occasionally a desired movement of a metering piston does not occur. With regard to this, according to a preferred further development of the present invention it is suggested that a carrier pin is provided through which both metering pistons are mechanically force-coupled and which for example is operative in the return movement between the first and the second metering pistons.

Insofar as the above has been applied to the first and second elements of the multi-chamber container according to the invention, this should just be regarded as a discriminability and not a final enumeration. A container provided with a first and a second component can also comprise other components having the same function. In the axial direction of the multi-chamber container a large number of chambers can be provided with assigned rising pipes.

BRIEF DESCRIPTION OF THE DRAWINGS

In the following, the present invention is explained in more detail based on an embodiment in conjunction with the drawing. This shows the following.

DETAILED DESCRIPTION OF THE INVENTION

Figure 1:
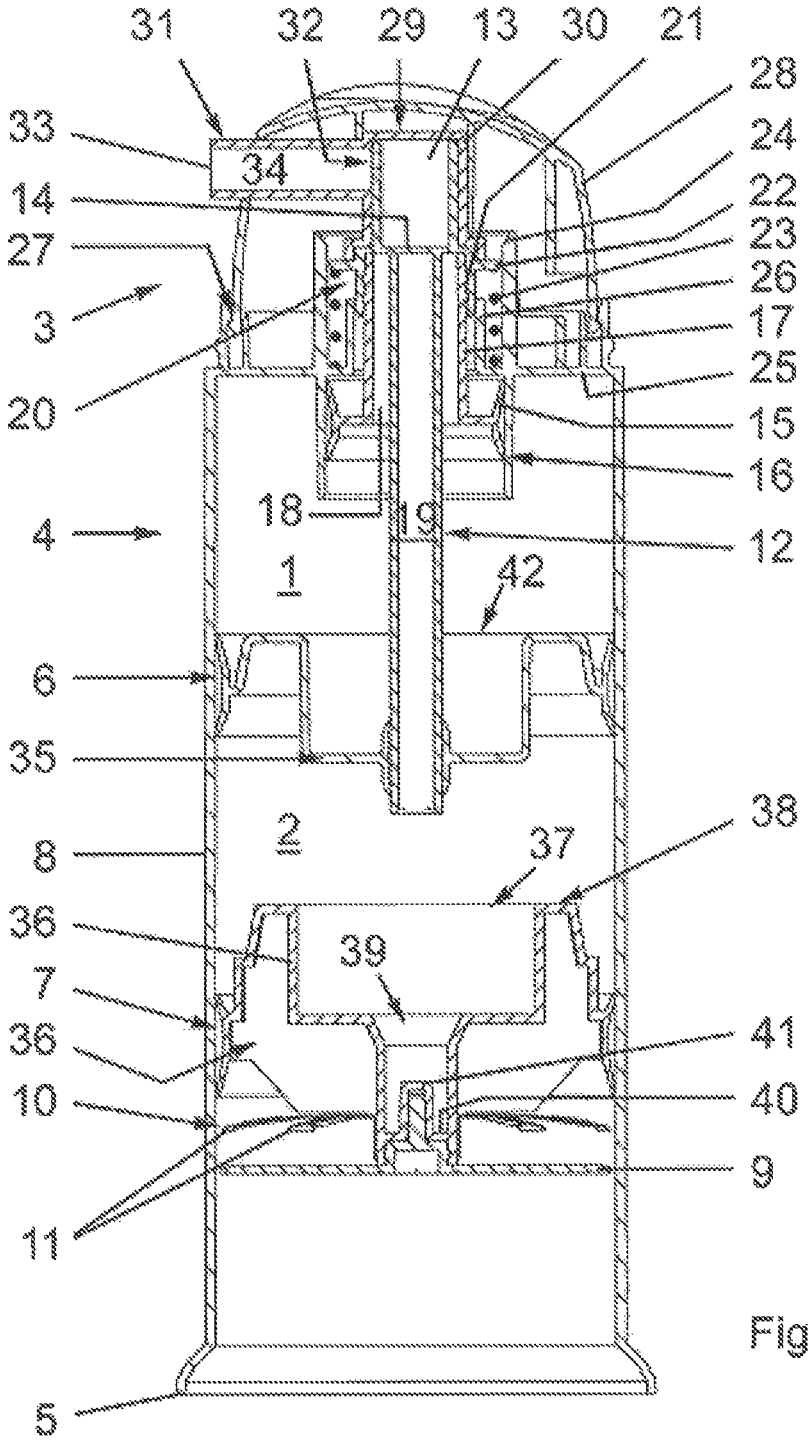
FIG. 1 a longitudinal sectional view of a first embodiment of the multi-chamber container according to the invention.

FIG. 1 illustrates a longitudinal sectional view of an embodiment of a multi-chamber container which has a first chamber 1 and a second chamber 2 located thereunder. In the present case the upper end of the multi-chamber container is formed by a metering head 3, whereas the oppositely situated end of an essentially cylindrical housing 4 forms a base 5. In this housing 4 a first piston 6 and a second piston 7 as trailing piston are provided and sealed with respect to the inner circumferential surface of a cylindrical section 8 of the housing 4. The second piston 7 is assigned a bottom plate 9 and a closing spring 10 which is located between the bottom plate and the second piston 7. The closing spring 10 has a large number of spring protrusions 11, which claw against the inner circumferential surface of the cylindrical section 8 and slope downwards slightly so that they permit a movement of the second piston 7 in the direction of the metering head 3, but prevent movement in the opposite direction.

The first piston 6 has a rising pipe 12 passing through it, the lower end of which opens out in the second chamber 2 and which communicates with a discharge chamber 13 via an opening, which cannot be recognised in the sectional view and which is located on the bottom 14 of the discharge chamber 13. At the upper end of the first chamber 1 the rising pipe 12 passes through a metering piston 15, which is movable and sealed in a cylindrical metering chamber 16. The metering piston 15 is formed in one piece with a metering duct 17, which protrudes beyond the metering piston 15 at the top and between it and the rising pipe 12 leaves an annular metering channel 18 free which similarly leads to the discharge chamber 13. For this purpose an opening, which is not illustrated, is also provided in the bottom 14 of the discharge chamber 13. The respective openings for the metering channel 18, which is designated the first metering channel in the following, and a second metering channel 19, formed by the rising pipe 12, can be embodied differently in size in order to obtain a desired throttle function and to facilitate influence on the respective volume flows during a pump movement of the metering head 13.

The discharge chamber 13 is formed by a rotationally symmetrical component 20, which forms a mounting flange 21 on the underside of the bottom of the discharge chamber 14. At roughly the upper end of the mounting flange 21 a contact disc 22 for a return spring 23 protrudes beyond it. The contact disc 22 is surrounded at a slight distance externally by a cylindrical collar 24 which projects from a chamber cover 25 covering the cylindrical section 8 of the housing 4 and is formed as one piece with the housing 4. Radially within the cylindrical collar 24 there is a guiding collar 26 similarly formed as one piece with the chamber cover 25.

The return spring 23 is located in an annular gap between the guiding collar 26 and the cylindrical collar 24. The inner circumferential surface of the guiding collar 26 interacts with the external circumferential surface of the mounting flange 21 and guides its axial movements in relation to the cylindrical section 8. A certain guidance function is also attributed to the front end of the contact disc 22 in conjunction with the cylindrical collar 24.

At its outer edge the chamber cover 25 has an annular latching groove 27 protruding over it at the top in which a covering cap 28 of the metering head 3 engages and is movable. This covering cap 28 forms a cylindrical discharge chamber receptacle 29, which encompasses the cylindrical discharge chamber 13 which is open at the top. This discharge chamber receptacle 29 forms a covering cap 30, which covers the discharge chamber 13 at the top and a removal pipe 31 extending transversely to the longitudinal axis of the cylindrical section 8. Within the removal pipe 31 the discharge chamber 13 has two discharge openings 32 which open in the radial direction and which lead to the removal pipe 31. FIG. 1 illustrates only one of the discharge openings 32. The discharge chamber 13 has in this case a partition wall extending essentially parallel to the drawing plane as in FIG. 1, so that the first chamber communicates with a corresponding discharge opening 32 via a first discharge sectional chamber, whereas the second chamber communicates via the rising pipe with a second discharge sectional chamber, which opens to the removal pipe 31 via a dedicated discharge opening. With an embodiment of this nature the removal pipe 31 is also provided with a partition wall. The embodiment enables a separate discharge of substances at a removal opening 33 of the removal pipe 31. A partition wall on the removal pipe 31 can be dispensed with just as well, so that the substances to be conveyed come into contact already in the removal pipe 31, optionally mixed together by appropriate flow resistances in the removal pipe 31. With an alternative embodiment only one discharge opening 32 can be provided and the mixing occurs in a uniform discharge chamber 13.

In the following the function of the embodiment illustrated in FIG. 1 is described:

For the removal of substances from the first chamber 1 and the second chamber 2 the pivotable cover 30 is pivoted relative to the discharge chamber 13 so that the relevant discharge channels 34 formed by the removal pipe 31 are each flush with the discharge opening 32. By pressing the cover 30 against the force of the return spring 23, the metering piston 15 in the metering chamber 16 is pushed downward. In this way liquid product components contained in the first chamber 1 are initially compressed. This pressure is passed on to the second chamber 2 via the movable first piston 6. The relevant product component rises upward due to this pressure. The product component contained in the first chamber 1 rises via the first metering channel 18 into the discharge chamber 13. The product component contained in the second chamber rises via the second metering channel 19 into the discharge chamber 13. Separated from one another, the product components pass via the respective sectional chambers of the discharge chamber 13 through the discharge openings 32 into the respectively separate discharge channels 34.

When the covering cap 28 is released, it is returned to its initial position illustrated in FIG. 1 by the return spring 23. A relative negative pressure is produced within the first chamber 1 which is passed on to the second chamber 2 by the movable first piston 6. Both pistons 6, 7 compensate for this negative pressure by a movement in the direction towards the metering head 3.

As already stated above, the metering head 3 is pivotably supported on the housing 4. The latching groove 29 facilitates free rotation of the metering head 3 relative to the housing 4. The component 20 and therefore the discharge chamber 13 are held against rotation with respect to the housing 4. This can be achieved for example by guiding the metering piston 15 in a guide groove. Alternatively, an appropriate longitudinal guiding groove can also be formed on the guiding collar 26. A corresponding guide ridge provided for this on the external circumferential surface of the mounting flange 21 is introduced into a corresponding longitudinal groove when the component 20 latches with the metering duct 17. Various methods of holding the component 20 against rotation with respect to the housing 4 are known to the person skilled in the art.

Due to the relative rotational feature of the metering head 3 and discharge chamber 13, the removal pipe 31 can be pivoted about the discharge chamber 13. Here, positions can be reached in which the respective discharge channels 34 surround both discharge openings 32, in which both discharge openings are enclosed by the cover 34 or intermediate positions in which one discharge opening 32 is closed and the other is freely open to the discharge channel 34. It is also conceivable that the relevant discharge openings are embodied slightly elongated in the circumferential direction and with variable size so that the cover 30 can at least partially cover one discharge opening, whereas the other is completely covered or remains free to the maximum extent. Through these measures various mixing ratios can be set. For example, it is possible to discharge 100% of only one product component from one of the chambers 1, 2. In one position of the metering head 3 in which all discharge openings 32 are covered the metering head 3 can also be locked in the axial direction so that pump actuation of the metering head 3 is prevented. If required, the mixing ratio can be set at the factory. To do this the metering head 3 only needs to be held in the required position, secure against rotation with respect to the housing 4. In order to eliminate unnecessary seeking of the discharge openings 32 by rotating the metering head 3, the metering head 3 is not usually pivotable through 360°, but rather is only pivotable through the required angular positions. In other words the removal pipe 31 can only be located in the vicinity of the discharge openings 32, namely also in a position in which the discharge openings 32 are closed by the cover 30.

With increasing emptying the first piston 6 approaches the metering chamber 16. Further approaching is facilitated in that the first piston 6 forms a cylindrical protrusion 35, which is provided concentrically to the rising pipe 12 and which is sealed in its bottom with respect to the rising pipe 12. The protrusion 35 forms a pot-shaped recess 42 matching the metering chamber 16 and into which the metering chamber 16 moves when approaching closer. The edges of the protrusion 35 are smooth and suitable for contacting the inner side of the chamber cover 25. The circumferential seal formed by the first piston 6 is at the same height as this front-sided ring surface of the first piston 6.

Also the second piston 7 has a protrusion 36 extending downwards which forms a recess 37 for the cylindrical protrusion 35 of the first piston 6. The pot-shaped recess 37 formed by the protrusion 36 has at the edge a ring surface 38 protruding over it which can contact the underside of the annular piston wall of the first piston 6.

From the pot-shaped recess 37 a rising pipe receptacle 39 extends concentrically, which is formed cylindrically with an internal diameter which is slightly larger than the external diameter of the rising pipe 12. A centring pin 41, which is formed in the vicinity of its front surfaces with oblique surfaces for introduction into the rising pipe, is provided concentrically to the rising pipe receptacle 39 on a base 40 of the second piston 7. The rising pipe receptacle 39 has an axial extension, which facilitates insertion of the rising pipe 12 into the second piston 7 until it contacts the underside of the first piston 6 with its corresponding ring surface 38. Preferably, the rising pipe receptacle 39 is dimensioned such that the rising pipe 12 contacts the base 40 on the front side in this end position corresponding to maximum emptying of the multi-chamber container and is closed. Furthermore, in the end position the bottom of the protrusion 35 of the first piston 6 contacts the metering chamber 16. In the said end position the two pistons 6, 7 accordingly close the passage for the product components into the discharge chamber. This therefore prevents a mixture of air and product component from being suddenly discharged from the removal pipe when the metering head 3 is actuated.

Figure 2:
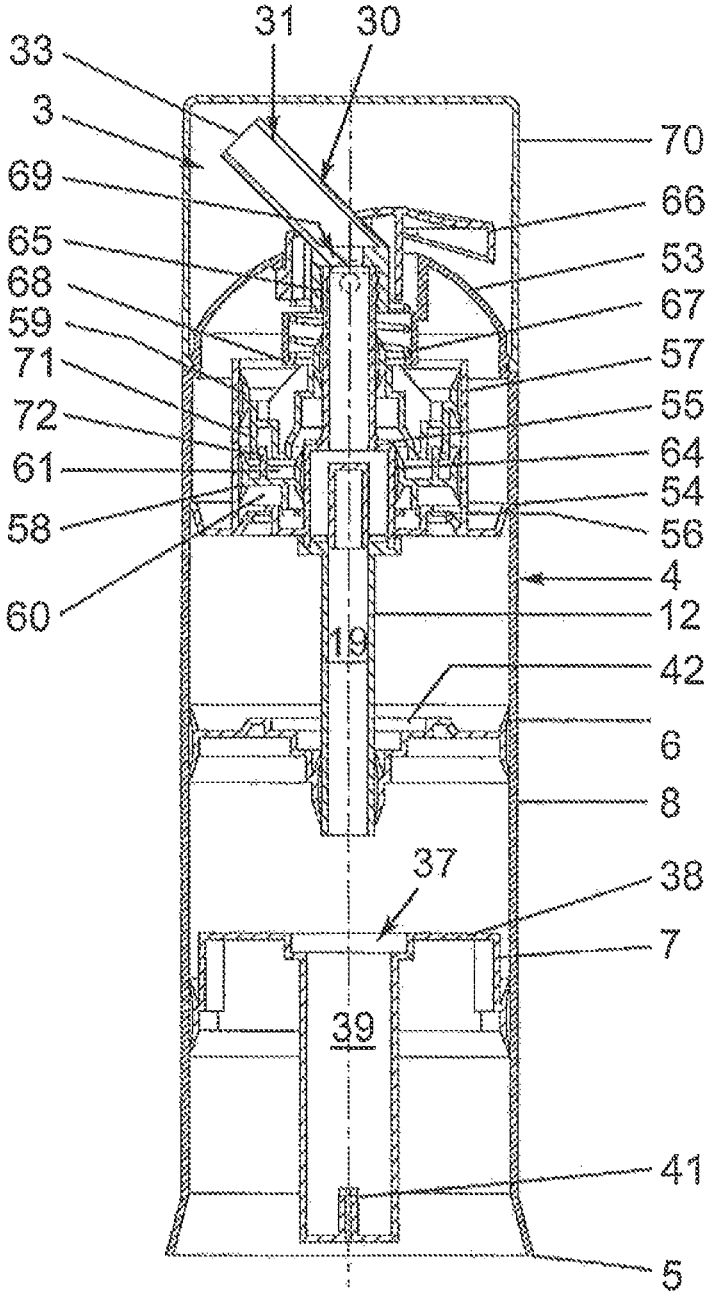
FIG. 2 a longitudinal sectional view of a second embodiment of the multi-chamber container according to the invention.
Figure 3:
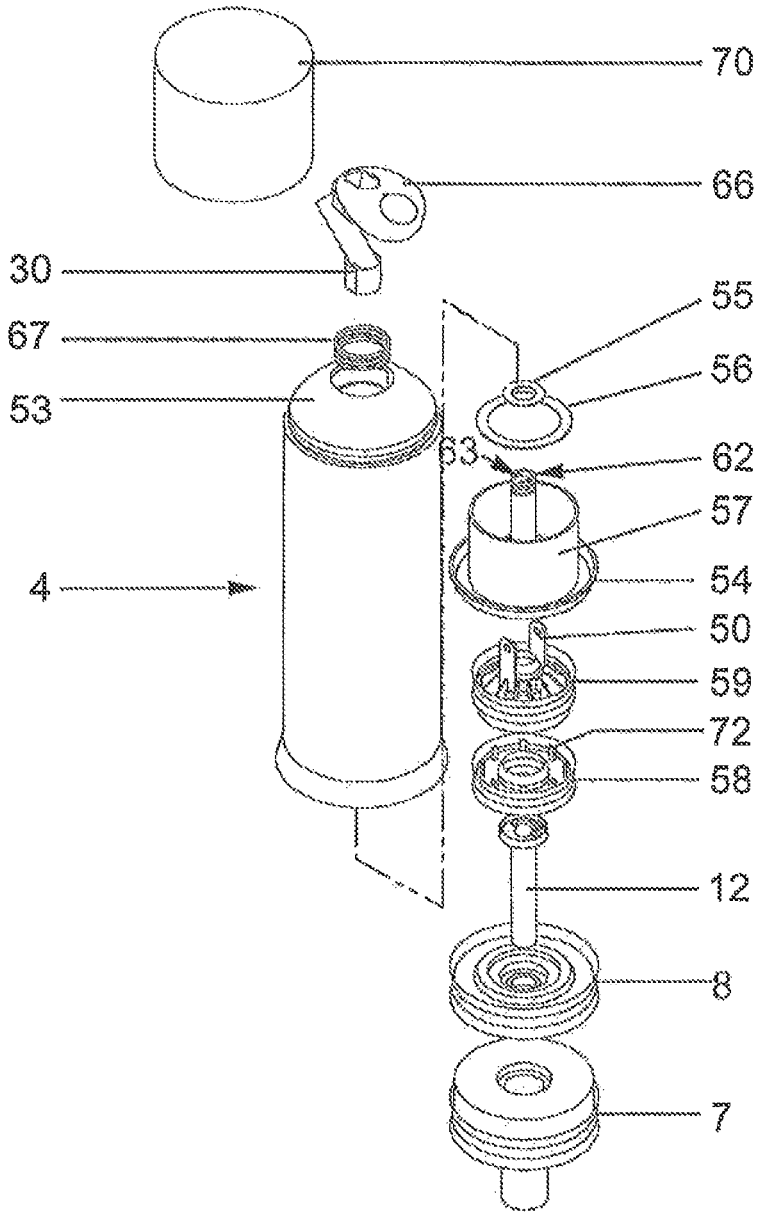
FIG. 3 an exploded drawing of the main parts of the embodiment illustrated in FIG. 2.
Figure 4:
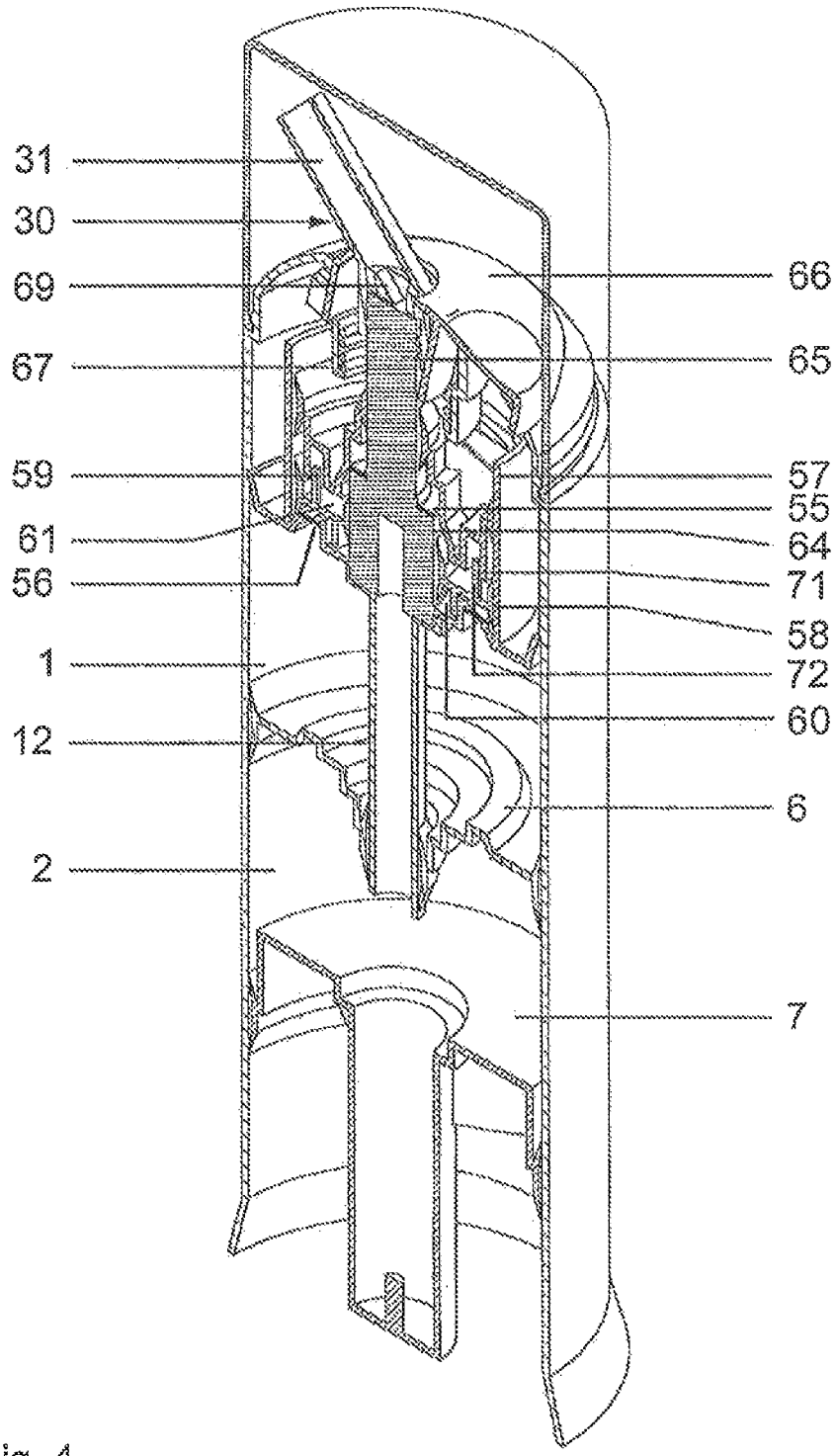
FIG. 4 a perspective longitudinal sectional view of the embodiment illustrated in FIGS. 2 and 3 and FIG. 5 an enlarged illustration of a detail of the discharge chamber of the embodiment illustrated in FIG. 1.

An alternative embodiment to the one illustrated in FIG. 1 is documented in FIGS. 2 to 4. The same components with respect to the embodiment in FIG. 1 are given the same reference numerals.

With regard to the matching of the contours of the first and second pistons 6, 7 for the best possible emptying of the multi-chamber container the above description can be used as reference. In this respect the illustrated embodiment indeed differs with respect to the selected outline of the pistons 6, 7. However, the objective here is also to obtain a shape which facilitates the best possible emptying of the container through the engaging of the contours of the pistons 6, 7 as well as the chamber cover 25.

A significant difference to the previously discussed embodiment is that the embodiment illustrated in FIGS. 2 to 4 comprises a separate metering device in the form of pumps for each of the chambers 1, 2. In the embodiment illustrated in FIGS. 2 to 4 the components are drawn up for dispensing. The two pistons 6, 7 follow the negative pressure. Accordingly, it is possible to dispense with a closing spring.

With the embodiment illustrated in FIGS. 2 to 4 the housing 4 has a housing cap 53 formed in one piece by means of injection moulding. The first and second pistons, 6, 7 are pushed into this component from below. First though, a housing partition 54 is pushed into the cylindrical section 8 (cf. FIG. 3). For the respective components contained in the chambers 1, 2 the housing partition 54, which is pushed into the housing 4 where it latches, forms separate channels which lie open toward the front side of the housing partition 54. The rising pipe 12 is formed as a separate component and latches with the housing partition 54. The housing partition 54 initially continues the formation of the flow channel 19 formed by the rising pipe 12. This terminates on the valve elements 55, which are provided on a ring surface of the housing partition 54. The housing partition 54 has first valve elements 56, which are assigned to the first chamber 1, radially outside of the flow passage for the second component. The valve elements 55, 56 are in effect prior-art non-return valves, which facilitate flow from the relevant chambers 1, 2, but prevent flow in the opposite direction.

The housing partition 54 forms a cylinder 57 protruding beyond the chamber cover 25 at the top. The first and second metering pistons 58, 59 are movable and sealed in this cylinder 57. Between the first metering piston 58 and the chamber cover 25 a first pump chamber 60 is formed in which the valve elements 56 are also located. A second pump chamber 61, which is supplied from two valve elements 55, is formed between the first metering piston 58 and the second metering piston 59.

Internally, the housing partition 54 forms the first and second metering channels 62, 63 which are open toward the front side of the housing partition 54. The first metering channel 62 communicates with the first pump chamber 60 through one or several radial holes. The second pump chamber 61 communicates with the second metering channel 63 through corresponding radial holes provided in the housing partition 54. The external circumferential surfaces of the housing partition 54 are cylindrical with a first sealing section 64 for the first metering piston and a second sealing section of smaller radius for the second metering piston 59. The first and second metering pistons 58, 59 contact the corresponding sealing sections 64, 65 in a sealed manner and are movable with respect to the housing partition 54.

On the second cylindrical sealing section 65 a cover 30 is latched at the top, which bears a removal pipe 31, which extends diagonally outwards. The removal pipe 31 passes through a button 66, which is guided movably in the housing head 53 and under tension from a return spring 67 is maintained in the initial position illustrated in the FIGS. 2 to 4. At the top end the spring 67 bears upon the button 66 and at the lower end against a collar 68 which is formed in one piece with the housing head 53. The button is joined to the metering piston 59 through the lugs 50.

In the extension of the removal pipe 31 the cover 30 has a closing tongue 69, which protrudes radially beyond the housing partition 54 and respectively the second sealing section 65. The button 66 is firmly fixed against rotation to the cover 30 and is pivotable in any case within limits with respect to the housing 4. This pivoting movement alternatively covers the first or the second metering channel 62 completely or partially with the tongue 69. In this way the mixing ratios can be changed or even the dispensing of a single component from the assigned chamber 1, 2 can be completely suppressed.

The housing 4 can be covered with a closing cap 70, which can latch onto the housing 4, 5, for protecting the metering device against unintentional operation.

In the following the use of the embodiment illustrated in FIGS. 2 to 4 is explained:

First, the closing cap 70 is removed. Then the required metering ratio is set by rotating the button relative to the housing 4. Indicators, which for example are printed in the vicinity of the housing head 53 and on the button 66, identify the set mixing ratio. The movement of the button 66 against the returning force of the spring 67 is transferred via the lugs 50 on the piston 59 and thus the piston 59 is pressed downwards in the direction of the first chamber 1. In this way the product component contained in the first chamber 1 is compressed. As a reaction to this, the product in the second chamber 2 is also compressed. It rises through the rising pipe 12, passes the valve element 55 and enters the second pump chamber 61. The product component from the first chamber 1 passes the valve element 56 and enters the first pump chamber 60. On releasing the button 60 it is restored to its initial position illustrated in FIGS. 2 and 4 by the returning force of the spring 67. Here, the first metering piston 58 approaches the chamber cover 25 under compression of the volume in the corresponding pump chamber 60. Likewise, the second metering piston 59 approaches the first metering piston 58 under compression of the volume in the second pump chamber 62. The volume contained in the pump chambers 60, 61 is forced inside the housing partition 54 and from there into the respective metering channels 62, 63. The corresponding components rise through the metering channels 62, 63 and are discharged through the removal pipe 31 in a predetermined mixing ratio at the front depending on the position of the closing tongue 69.

The cover 30, which can also be designated as a nozzle, is preferably pivotable over 180°, so that each of the front openings of the metering channels 62, 63 can be covered by the closing tongue 69. Intermediate positions between the end positions at 0° and 180° lead to a mixture of the two components which are discharged through the metering channels 62, 63. The product component from the first chamber 1 or second chamber 2 can then be discharged variably in a mixing ratio from 0% to 100%. The sealing of one of the metering channels results in a reduction of the available compression volume of the assigned pump chamber the next time the button 66 is pressed down. With complete sealing, for example, of the first metering channel the assigned first pump chamber 1 can no longer be reduced in volume the next time the button 66 is pressed down. Consequently, when the button 66 is actuated again and released, no further product component is drawn from the first chamber.

The first and second metering pistons are connected to one another by the carrier pins (71, 72) illustrated in FIG. 2, which are operative between the two pistons 58, 59 during a restoration movement by the return spring 67, so that both pistons 58, 59 are carried along during lifting. In this way it is ensured that when lifting is terminated both pistons 58, 59 are in their initial positions in which the second metering piston 59 butts up against the collar 68.

The mixing ratio of the two components can also be variably adapted with the embodiment illustrated in FIGS. 2 to 4. The embodiments illustrated in FIGS. 1 to 4 offer the advantage of a space-saving arrangement of a multi-component dispenser with the possibility of variably adjusting mixing ratios. In this regard the respective chambers 1, 2 are arranged one above the other for the different components. It goes without saying that according to the principle described above also more than two chambers can be provided one above the other.

Figure 5:
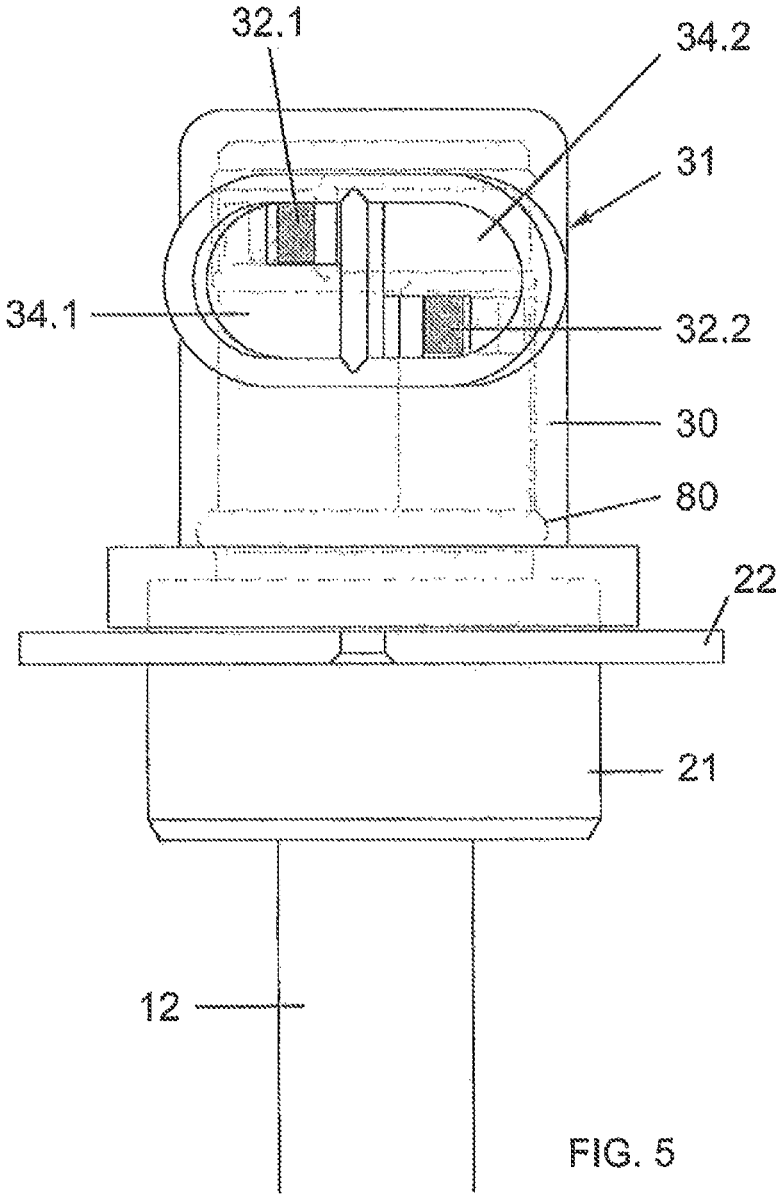

FIG. 5 illustrates the adjustability of the mixing ratios of the embodiment described in FIG. 1. Two discharge openings 32.1 and 32.2 can be seen which lead to the respective discharge chambers 13 for the different product components. The removal pipe 31 is also divided and has two separate discharge channels 34.1 and 34.2. FIG. 5 also illustrates a latching protrusion 80 provided on the external circumferential surface of the discharge chamber 13 and which interacts with a correspondingly formed latching groove on the cover in order to fix both parts in the axial direction. As can be seen, the mixing ratio can be changed by rotating the cover 30 relative to the component 20.

The present invention is not restricted to the illustrated embodiment. To fill the housing from above, i.e. from the side closed by the metering head 3, it can be latched onto the cylindrical housing 4. The unit comprising the metering head can here comprise the chamber cover 6 which is placed on the front side of the housing 4 and latches with it. In other words with an alternative embodiment of this nature the housing essentially consists of a cylindrical component with a slightly widened base area at the bottom and latching elements at the oppositely situated ends of the cylinder for latching with the chamber cover, which in line with the illustrated embodiment is formed in one piece with the metering chamber 16 and bears the metering head.

LIST OF REFERENCE NUMERALS

1 First chamber
2 Second chamber
3 Metering head
4 Housing
5 Base area
6 First piston
7 Second piston
8 Cylindrical section
9 Bottom plate
10 Closing spring
11 Spring protrusions
12 Rising pipe
13 Discharge chamber
14 Bottom of the discharge chamber
15 Metering piston
16 Metering chamber
17 Metering duct
18 First metering channel
19 Second metering channel
20 Component
21 Mounting flange
22 Contact disc
23 Return spring
24 Cylindrical collar
25 Chamber cover
26 Guiding collar
27 Latching groove
28 Covering cap
29 Discharge chamber receptacle
30 Cover
31 Removal pipe
32 Discharge opening
33 Removal opening
34 Discharge channel
35 Protrusion, first piston
36 Protrusion, second piston

37 Pot-shaped recess, second piston
38 Ring surface
39 Rising pipe receptacle
40 Base
41 Centring pin
42 Pot-shaped recess, first piston
50 Lug
53 Housing head
54 Housing partition
55 Valve element for second component
56 Valve element for first component
57 Cylinder
58 First metering piston
59 Second metering piston
60 First pump chamber
61 Second pump chamber
62 First metering channel
63 Second metering channel
64 First sealing section
65 Second sealing section
66 Button
67 Return spring
68 Collar
69 Closing tongue
70 Closing cap
71 Carrier pin
72 Carrier pin
80 Latching protrusion

The invention claimed is:

1. A multi-chamber container comprising:

a container housing (4), comprising a first chamber (1) for accommodating a first product component and a second chamber (2) for accommodating a second product component, wherein the first chamber (1) is arranged between the second chamber (2) and a housing head (3);

a first piston (6) arranged between the first and second chambers (1, 2) for separating the first from the second chamber (1, 2) and a second piston (7) which closes the second chamber (2), the first piston (6) and the second piston (7) being movably arranged one above the other in a cylindrical section (8) of the container housing (4);

a rising pipe (12) which protrudes into the second chamber (2) and passes through the first piston (6) and the first chamber (1);

a metering and pump device (15, 16) comprising a single metering chamber (16) concentrically arranged to the cylindrical section (8) which communicates with at least one of the first chamber and the second chamber (1, 2), a metering piston (15), a discharge chamber (13) and a return spring (23), wherein the metering piston (15) is formed in one piece with a metering duct (17) extending in actuation direction of the metering piston (15) and protruding the metering piston (15) at the top and is movable and sealed in a cylindrical section of the metering chamber (16), an annular gap between the metering duct (17) and the rising pipe (12) forms a first metering channel (18) which communicates with the discharge chamber (13) via an opening provided at the bottom of the discharge chamber (13), the rising pipe (12) forms a second metering channel (19) which communicates with the discharge chamber (13) via a further opening, and the discharge chamber (13) has a mounting flange (21) at an underside of the bottom and a contact disc (22) for the return spring (23);

a chamber cover (25) covering the cylindrical section (8) of the container housing (4) and thereby the first chamber (1), the chamber cover (25) is projected by a cylindrical collar (24), which surrounds the contact disc (22) and a guiding collar for guiding an external circumferential surface of the mounting flange (21), wherein the return spring (23) is provided in an annular gap between the guiding collar and the cylindrical collar (24); and a removal opening (33) arranged on the housing head (3) which communicates via the discharge chamber (13) with the first chamber (1) and via the discharge chamber (13) and the rising pipe (12) with the second chamber (2).

2. The multi-chamber container according to claim 1, characterised in that the first piston (6) is sealed with respect to the rising pipe (12).

3. The multi-chamber container according to claim 1, characterised in that the first piston (6) and the second piston (7) are arranged such that contours formed on the first piston (6) and the second piston (7) engage one another when the chambers (1, 2) are emptied.

4. The multi-chamber container according to claim 3, characterised in that the metering chamber (16) protrudes from the housing head (3) into the first chamber (1), the first piston (6) has a first pot-shaped recess (42) into which the metering chamber (16) fits and the second piston (7) has a second pot-shaped recess (37), into which the first pot-shaped recess (42) fits.

5. The multi-chamber container according to claim 1, characterised in that the second piston (7) forms a cylindrical rising pipe receptacle (39).

6. The multi-chamber container according to claim 5, characterised in that a centring pin (41) for the rising pipe (12) is arranged in the cylindrical rising pipe receptacle (39).

7. The multi-chamber container according to claim 6, characterised in that the cylindrical rising pipe receptacle (39) includes a base (40), wherein the base (40) forms a sealing face for the rising pipe (12), to which the rising pipe (12) abuts when the second chamber (2) is emptied to the maximum extent.

8. The multi-chamber container according to claim 1, characterised in that the metering piston (15) opens out into a first discharge chamber (13) for the one product component and a second discharge chamber (13) for the other product component is provided, the discharge chambers (13) have discharge openings (32.1; 32.2) at approximately the same height, and a removal pipe (31) which is supported for rotation about the discharge chambers (13) protrudes from the discharge openings (32.1, 32.2).

9. The multi-chamber container according to claim 8, characterised in that the removal pipe (31) is joined to the housing head (3), is movable in the actuation direction of the metering piston (15), and is pivotably supported on the container housing (4).

10. A multi-chamber container comprising:

a container housing (4), comprising a first chamber (1) for accommodating a first product component and a second chamber (2) for accommodating a second product component, wherein the first chamber (1) is arranged between the second chamber (2) and a housing head (3);

a first piston (6) arranged between the first and second chambers (1, 2) for separating the first from the second chamber (1, 2) and a second piston (7) which closes the second chamber (2) which pistons (6, 7) are movably arranged one above the other in a cylindrical section (8) of the container housing (4); and a rising pipe (12) which protrudes into the second chamber (2) and passes through the first piston (6) and the first chamber (1); and a metering and pump device comprising:

a housing partition (54) which forms a cylinder (57) that protrudes beyond a top of a chamber cover (25) inserted into the cylindrical section (8) of the container housing (4) and internal first and second metering channels (62, 63) which are open toward a front side of the housing partition (54); wherein the housing partition (54) continues the formation of a flow channel (19) formed by the rising pipe (12), which latches with the housing partition (54) as a separate component;

the housing partition (54) has radially outwards from the flow channel (19) first non-return valve elements (56) which are assigned to the first chamber (1); and wherein the housing partition (54) has a ring surface which is provided with second non-return valve elements (55) on which the flow channel (19) terminates;

first and second metering pistons (58, 59) forming a first and second pump chamber (60, 61), which are movable and sealed in the cylinder (57) of the housing partition (54), wherein:

the first pump chamber (60) is formed between the first metering piston (58) and the chamber cover (25) and communicates through the interposition of the first valve elements (56) with the first chamber (1);

the second pump chamber (61) is formed between the first and second metering pistons (58, 59) and communicates through the interposition of the second valve elements (55) via the flow channel (19) with the second chamber (2);

the first metering channel (62) communicates with the first pump chamber (60) through one or several radial holes provided in the housing partition (54); and wherein the second metering channel (63) communicates with the second pump chamber (61) through one or several radial holes provided in the housing partition (54); and a removal opening (33) arranged on the housing head (3) which communicates via the first metering channel (62) and the first pump chamber (61) with the first chamber (1) and via the second metering channel (63), the second pump chamber (61) and the flow channel (19) with the second chamber (2).

11. The multi-chamber container according to claim 10, characterised in that metering channels (62, 63) each extend in an actuation direction of the first and second metering pistons (58, 59) and are surrounded by a dispensing pipe, on which a pivotably supported removal pipe (31) is mounted at the front, the removal pipe (31) bearing a closing element (69), with which a discharge opening of each of the metering channels (62, 63) can be completely or partially covered.

12. The multi-chamber container according to claim 10, characterised in that the housing head (53) is firmly joined to the housing (4) and movably supports a metering button (66), which is subjected to a return spring (67), which brings the metering pistons (58, 59) into an initial position.

13. The multi-chamber container according to claim 10, characterised in that the metering duct (65) forming metering channels (62, 63) is latched with the removal pipe (31).

14. The multi-chamber container according to claim 12, characterised by a carrier pin (71, 72), which is operative via movement of the return spring (67) between the first and second metering pistons (58, 59).

15. A multi-chamber container comprising:

a container housing (4), comprising a first chamber (1) for accommodating a first product component and a second chamber (2) for accommodating a second product component, wherein the first chamber (1) is arranged between the second chamber (2) and a housing head (3);

a first piston (6) arranged between the first and second chambers (1, 2) for separating the first from the second chamber (1, 2) and a second piston (7) which closes the second chamber (2), the pistons (6, 7) being movably arranged one above the other in a cylindrical section (8) of the container housing (4);

a rising pipe (12) which protrudes into the second chamber (2) and passes through the first piston (6) and the first chamber (1);

a metering and pump device (15, 16) comprising a single metering chamber (16) concentrically arranged to the cylindrical section (8) which communicates with at least one of the first chamber and the second chamber (1, 2), a metering piston (15), a first discharge chamber (13), and a second discharge chamber (13), wherein the first chamber (1) communicates with the first discharge chamber (13) via a first metering channel (18) disposed in an annular gap between a metering duct (17) and the rising pipe (12), wherein the metering duct (17) extends in an actuation direction of the metering piston (15) and protrudes the metering piston (15) at the top, wherein the rising pipe (12) forms a second metering channel (19) which communicates with the second discharge chamber (13) via a further opening, wherein the metering piston (15) opens out into the first discharge chamber (13) for the first product component, and wherein the discharge chambers (13) have discharge openings (32.1; 32.2) at approximately the same height; and a removal opening (33) arranged on the housing head (3) which communicates via the first discharge chamber (13) with the first chamber (1) and via the second discharge chamber (13) and the rising pipe (12) with the second chamber (2); and a removal pipe (31) which is supported for rotation about the discharge chambers (13) protrudes from the discharge openings (32.1, 32.2).

16. The multi-chamber container according to claim 15, characterised in that the removal pipe (31) is joined to the housing head (3) is movable in the actuation direction of the metering piston (15), and is pivotably supported on the container housing (4).

* * * * *